US009059510B2

(12) United States Patent
Harper

(10) Patent No.: US 9,059,510 B2
(45) Date of Patent: Jun. 16, 2015

(54) DIELECTRIC CHIP ANTENNAS

(75) Inventor: Marc Harper, Cambridge (GB)

(73) Assignee: Microsoft Technology Licensing, LLC, Redmond, WA (US)

( * ) Notice: Subject to any disclaimer, the term of this patent is extended or adjusted under 35 U.S.C. 154(b) by 330 days.

(21) Appl. No.: 13/636,921

(22) PCT Filed: Mar. 22, 2011

(86) PCT No.: PCT/GB2011/050564

§ 371 (c)(1),
(2), (4) Date: Sep. 24, 2012

(87) PCT Pub. No.: WO2011/117621

PCT Pub. Date: Sep. 29, 2011

(65) Prior Publication Data

US 2013/0021216 A1 Jan. 24, 2013

(30) Foreign Application Priority Data

Mar. 26, 2010 (GB) ..... 1005121.7

(51) Int. Cl.
*H01Q 7/08* (2006.01)
*H01Q 9/30* (2006.01)
*H01Q 7/00* (2006.01)

(52) U.S. Cl.
CPC . *H01Q 9/30* (2013.01); *H01Q 7/00* (2013.01); *H01Q 5/385* (2015.01); *H01Q 5/40* (2015.01)

(58) Field of Classification Search
CPC ..... H01Q 5/01; H01Q 7/00; H01Q 9/04; H01Q 9/138
USPC ..... 343/788, 700 MS, 702
See application file for complete search history.

(56) References Cited

U.S. PATENT DOCUMENTS 3,909,830 A 9/1975 Campbell
5,861,854 A 1/1999 Kawahata et al.
(Continued)

FOREIGN PATENT DOCUMENTS

CN 1930734 A 3/2007
CN 1993860 A 7/2007
(Continued)

OTHER PUBLICATIONS

Lee, Dr. Joanna, Patent Act 1977—Examination Report under Section 18(3); Application No. GB1005121.7, dated Mar. 5, 2014.
(Continued)

*Primary Examiner* — Huedung Mancuso
(74) *Attorney, Agent, or Firm* — Ladislav Kusnyer; Jeremy Snodgrass; Micky Minhas

(57) ABSTRACT

There is disclosed an antenna arrangement having a parasitic conductive loop (1) and at least one active radiating element (9). The conductive loop (1) comprises first and second electrically conductive passive radiating elements (2, 3) each with first and second ends. The first ends of the passive radiating elements are each connected to ground, and the second ends of the radiating elements are each connected respectively to mutually discrete metalized surface regions (8) of a dielectric block (7). The at least one active radiating element (9) is not conductively connected to the passive radiating elements (2, 3). The passive radiating elements (2, 3) are configured to be fed parasitically by the at least one active radiating element (9). The antenna arrangement has excellent resistance to detuning and can be located in different regions of a PCB substrate without significantly affecting performance. Further, the antenna is small in size and may be arranged for dual band operation.

27 Claims, 4 Drawing Sheets

(56) References Cited

U.S. PATENT DOCUMENTS

| | | | | |
|---|---|---|---|---|
| 6,177,908 | B1 | 1/2001 | Kawahata et al. | |
| 6,342,856 | B1 | 1/2002 | Nakano et al. | |
| 7,055,754 | B2 * | 6/2006 | Forster | 235/492 |
| 7,663,567 | B2 * | 2/2010 | Hilgers | 343/795 |
| 2003/0048225 | A1 | 3/2003 | Yoon | |
| 2003/0222827 | A1 | 12/2003 | Sung | |
| 2004/0090371 | A1 | 5/2004 | Rossman | |
| 2004/0108957 | A1 | 6/2004 | Nakano et al. | |
| 2004/0233111 | A1 * | 11/2004 | Desclos et al. | 343/700 MS |
| 2006/0061515 | A1 * | 3/2006 | Posluszny et al. | 343/803 |
| 2007/0182658 | A1 | 8/2007 | Ozden | |
| 2008/0122568 | A1 | 5/2008 | Yan et al. | |
| 2009/0040120 | A1 * | 2/2009 | Tsubaki et al. | 343/702 |
| 2009/0179812 | A1 | 7/2009 | Nakamura et al. | |
| 2009/0303144 | A1 | 12/2009 | Hirano | |
| 2010/0007575 | A1 | 1/2010 | Tsai et al. | |

FOREIGN PATENT DOCUMENTS

| | | | |
|---|---|---|---|
| CN | 101233532 | A | 7/2008 |
| CN | 101589507 | A | 11/2009 |
| EP | 0 766 341 | | 4/1997 |
| EP | 1 003 240 | | 5/2000 |
| EP | 1085595 | A2 | 3/2001 |
| EP | 1146589 | A1 | 10/2001 |
| EP | 1248316 | A2 | 9/2002 |
| EP | 1267411 | A2 | 12/2002 |
| EP | 1267441 | A2 | 12/2002 |
| EP | 1387435 | A1 | 2/2004 |
| EP | 1 482 592 | | 12/2004 |
| EP | 1498984 | A1 | 1/2005 |
| EP | 2048739 | A1 | 4/2009 |
| EP | 2 065 975 | | 6/2009 |
| EP | 2065975 | A1 | 6/2009 |
| GB | 2 472 779 | | 2/2011 |
| GB | 2472779 | A | 2/2011 |
| JP | 1127026 | A | 1/1991 |
| JP | 11-027026 | | 1/1999 |
| WO | WO 2006/000631 | | 1/2006 |
| WO | WO 2006000631 | A1 | 1/2006 |
| WO | WO 2006103311 | A2 | 10/2006 |
| WO | WO 2007147940 | A1 | 12/2007 |
| WO | WO 2010/004084 | | 1/2010 |
| WO | 2011117621 | A2 | 9/2011 |

OTHER PUBLICATIONS

"Office Action Received in United Kingdom Patent Application No. 1005121.7", Mailed Date: Oct. 17, 2013, Filed Date: Mar. 26, 2010, 3 pages.

"Office Action and Search Report Received in China Patent Application No. 201180015778.4", Mailed Date: Jan. 23, 2014, Filed Date: Mar. 22, 2011, 21 Pages.

Lee, Dr. Joanna, Patent Act 1977: Combined Search and Examination Report under Sections 17 and 18(3), dated Aug. 28, 2014.

"Office Action received for United Kingdom Patent Application No. 1412913.4", Mailed date: Aug. 28, 2014, 5 Pages.

"Second Office Action received for Chinese Patent Application No. 201180015778.4", Mailed Date: Oct. 15, 2014, 15 Pages.

"Third Office Action received for Chinese Patent Application No. 201180015778.4" mailed date: Apr. 22, 2015, 6 pages.

* cited by examiner

| MARKERS: | MHz | Ω |
|---|---|---|
| MDA-Chip.s1p | | |
| | 1: 2402 | 44.2-22.2i |
| | 2: 2480 | 46.4+29.5i |

DIELECTRIC CHIP ANTENNAS

CROSS-REFERENCE TO RELATED APPLICATIONS

This application is a National Phase Application of PCT International Application No. PCT/GB2011/050564, entitled "DIELECTRIC CHIP ANTENNAS", International Filing Date Mar. 22, 2011, published on Sep. 29, 2011 as International Publication No. WO 2011/117621, which in turn claims priority from GB Patent Application No. 1005121.7, filed Mar. 26, 2010, both of which are incorporated herein by reference in their entirety.

Embodiments of this invention relate to a surface mounted dielectric chip antenna having improved stability against detuning.

BACKGROUND

Surface mounted dielectric chip antennas are electrically small antennas often used on small platforms such as mobile communications devices. They are characterised by having a block of dielectric material mounted on a non-ground area of a circuit board. Conductive tracks are printed on the dielectric block and it is these tracks that form the antenna rather than the dielectric material itself.

Generally the dielectric chip antenna has a shape that is cuboid or a similar form of hexahedron, although other shapes are possible. A surface mounted chip antenna is generally characterised by having at least two conductive electrodes and often three; a feed electrode, a ground electrode and a radiation section. Sometimes monopole designs are used in which case there is no ground electrode; in this case additional solder pads, having no electrical functionality, may be used to add mechanical stability to the surface mounting process.

The antenna dielectric block material may be ceramic, resin or similar other dielectric material. The function of this dielectric block is to add mechanical support to the antenna and to reduce the antenna size. High dielectric ceramic materials (relative permittivity of 20 or greater) are often chosen, although this is not always the case.

Perhaps the simplest form of dielectric chip antenna is that described by EP 0766341 [Murata]. This discloses a quarter wave monopole printed on a dielectric block and fed capacitively across a small gap separating the feed electrode and the main radiating section of the antenna.

A more typical surface mounted dielectric chip antenna is disclosed in EP1482592 [Sony]. The antenna has feed and ground electrodes with a radiating section between the two. The resonant frequency of the antenna is determined by the pattern printed on the mounting board and not on the antenna itself. In this way the chip design does not need customisation for each application and the antenna is said to be standardised. The feed section printed on the mounting board is characterised as capacitive in nature because conductive plates on opposing sides of the mounting board are employed. In contrast, the grounded section printed on the mounting board is characterised as inductive in nature because of a narrow conductive strip that forms part of the design. By adjusting the form of these capacitive and inductive sections printed on the mounting board, the resonant frequency of the antenna may be adjusted without recourse to re-designing the dielectric chip itself. A variety of dielectric chip shapes are disclosed in EP1482592.

US 2003/0048225 [Samsung] discloses a surface mounted chip antenna having a dielectric block and separate feed, ground and radiation electrodes. The use of conductive patterns on the side surfaces of the dielectric block is disclosed as a means of lowering the resonant frequency and a T-shape is proposed for the feed section so as to aid matching. The dielectric block may have a hole in it to reduce weight and cost. The antenna is essentially capacitive in nature because of the capacitance between the feed and the ground electrode and the feed and the radiating electrode.

A broadband chip antenna is disclosed in US 2003/0222827 [Samsung]. Here a dielectric block has conductive electrodes disposed on two opposing end walls and parts of the top and bottom surfaces. One electrode is grounded, the other is a feeding element and the slot between the two electrodes gives rise to broadband RF radiation. No other information is given concerning feeding and grounding tracks as the antenna radiating element is considered to be the dielectric block and the electrodes disposed on it.

WO 2006/000631 [Pulse] discloses a similar arrangement of dielectric block metallization as US 2003/0222827. However, in this case the feeding and grounding arrangements on the circuit board are disclosed. One electrode is grounded (this is described as being a parasitic antenna) and the other electrode is connected to both the feed in one place and to ground in another, similar to the way a PIFA is fed. The width of the slot between the electrodes is used for tuning and matching. A ceramic material of relative permittivity 20 is used for the dielectric block material in the examples given.

WO 2010/004084 [Pulse] discloses metallization of a dielectric block so as to form a loop round the block. Generally the feed point is in one corner, but feeding half way along the dielectric block is also shown. A relative permittivity for the dielectric block of 35 is suggested.

EP 1003240 [Murata] discloses a similar arrangement of metallization, feeding and slot between electrodes to those shown in US 2003/0222827 and WO 2006/000631.

A slot diagonal to the sides of the dielectric block is proposed and the slot width varies along its length.

US 2009/0303144 discloses a dielectric chip antenna fed capacitively across a gap at one end and grounded at the other end so as to form a loop antenna arrangement. The feeding and grounding arrangements on the circuit board are disclosed and show a matching component on the feeding side and a frequency adjusting element (generally a capacitor or inductor) and the grounded side.

A further loop antenna arrangement is disclosed by US 2010/0007575. Here a loop is formed around the dielectric block and includes capacitive coupling between the upper and lower layers so as to complete the loop. The method of feeding is not shown in the figures but is said to be at one end of the block.

Most of the dielectric chip antennas described above are not stable against detuning, such as hand detuning when the antenna is deployed on a mobile device. Moreover, because the grounding arrangements of many of these chip antennas are crucial to their performance, the antenna performance is determined to some extent by the size and shape of the mounting board and the grounded area thereon. For example, a chip antenna may work well in the middle of one edge of the mounting board but not work well in one corner, or vice versa. It would therefore be desirable to provide an antenna having the advantage of the small size and cost of chip antennas but without the detuning and mounting sensitivities.

The present Applicant has explored the use of magnetic dipole antennas for mobile communications platforms in co-pending UK patent applications GB 0912368.8 and GB 0914280.3.

BRIEF SUMMARY OF THE DISCLOSURE

In accordance with the present inventions there is provided an antenna arrangement comprising first and second electrically conductive passive radiating elements each having first and second ends, the first ends of the passive radiating elements each being connected to ground, and the second ends of the radiating elements being connected respectively to mutually discrete metallized surface regions of a dielectric block, and at least one active radiating element that is not conductively connected to the passive radiating elements, wherein the passive radiating elements are configured to be fed parasitically by the at least one active radiating element.

The passive radiating elements are typically formed as conductive tracks on a dielectric substrate such as a PCB substrate. The dielectric block may be surface-mounted on the substrate. The substrate is typically planar, with upper and lower opposed surfaces. The second end of the first passive radiating element is electrically connected to a first metallized surface region of the dielectric block, and the second end of the second passive radiating element is electrically connected to a second metallized surface region of the dielectric block. The first and second metallized surface regions are not conductively connected to each other.

In some embodiments, additional passive radiating elements may be provided. For example, third and fourth conductive tracks may be formed on the dielectric substrate and connected to metallized surface regions of the dielectric block. The connections may be to the same metallized regions as the first and second conductive tracks, or may be to alternatively located metallized regions, which may or may not be conductively connected to the respective first and second metallized regions. The first and second conductive tracks may contact metallized regions of a first pair of opposed surfaces of the dielectric block, while the third and fourth conductive tracks may contact metallized regions of a second pair of opposed surfaces of the dielectric block. The first pair may be generally orthogonal in orientation to the second pair. In this way, an additional resonance or operating frequency or band may be introduced.

The passive radiating elements with the intervening dielectric block are advantageously arranged in a loop or hairpin configuration on the substrate, thereby taking the configuration of a magnetic antenna. The active radiating element, which acts as a feed for the passive radiating elements, may be located between the first ends of the passive radiating elements on the same surface of the substrate, or possibly on an opposed surface of the substrate.

The active radiating element may itself be in the form of a loop antenna that acts as a feed by coupling inductively with the passive radiating elements, or may be configured as a monopole that couples capacitively with the passive radiating elements.

In some embodiments, two or more active radiating elements may be provided.

The active radiating element may radiate at substantially the same frequency or in the same frequency band as the passive radiating elements, in which case it acts as a simple feed. In other embodiments, the active radiating element may alternatively or additionally radiate at a different frequency or in a different frequency band to the passive radiating elements, this frequency or frequency band being selected so as to provide an additional resonance (for multi-band operation) while still coupling with the passive radiating elements so as to cause these to resonate parasitically. In some embodiments, a first active radiating element may radiate at the same frequency or frequency band as the passive radiating elements, and a second active radiating element may radiate at a different frequency or in a different frequency band.

The dielectric block may be made of a dielectric ceramics material, and be of similar size and composition to those used in conventional dielectric chip antennas. The second ends of the passive radiating elements may connect to metallized pads formed on the dielectric block by conventional techniques. The metallized pads may be formed on opposing surfaces of the dielectric block, or on adjacent surfaces, or in some embodiments on the same surface. In some embodiments, each metallized pad may extend over an edge of the dielectric block so as to contact two adjacent surfaces simultaneously.

Viewed from one aspect, the present invention may be considered to be a parasitic antenna arrangement comprising a dielectric chip or block with opposed sides, each side being provided with metallization and connected to ground, either directly or via a matching circuit, and a feed antenna comprising a loop antenna with an RF feed point at one end and a connection to ground at the other end, the connection to ground being either direct or via a matching circuit. In certain embodiments, the feed antenna arrangement is not printed on the chip or block and is located on a main PCB separately from the chip.

Viewed from another aspect, the present invention may be considered to be a parasitic antenna arrangement comprising a dielectric chip or block with opposed sides, each side being provided with metallization and connected to ground, either directly or via a matching circuit, and a monopole feed antenna comprising an RF feed point at one end and a short monopole arranged so as capacitively to couple into the parasitic dielectric chip antenna. In certain embodiments, the feed antenna arrangement is not printed on the chip or block and is located on a main PCB separately from the chip, for example beneath the parasitic chip antenna on the opposing surface of the main PCB.

The present invention extends the concept of Magnetic Dipole Antennas to small dielectric chip antennas. These antennas are primarily intended to cover the Bluetooth™ and Wi-Fi frequency bands but operation at other frequencies is both possible and planned.

BRIEF DESCRIPTION OF THE DRAWINGS

Embodiments of the invention are further described hereinafter with reference to the accompanying drawings, in which.

DETAILED DESCRIPTION

Figure 1:
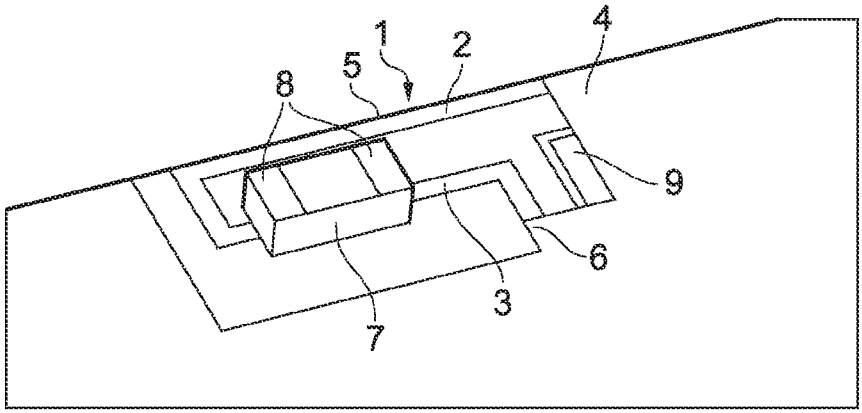
FIG. 1 illustrates a first embodiment of the present invention.

In a first embodiment of the present invention, as shown in FIG. 1, a main radiating antenna comprises a conductive loop 1 formed from conductive tracks 2, 3 formed on a PCB substrate 4 and grounded at both ends 5, 6. The loop 1 is interrupted by a dielectric chip capacitor 7 towards the centre of the loop 1. The inductance of the loop 1 and the capacitance of the metallised dielectric chip 7 give rise to resonance at a desired frequency of operation. The metallization 8 of the dielectric chip 7 is similar to that disclosed in US 2003/0222827 or WO 2006/000631, but the way in which the device is deployed on the mounting board 4 and the way in which it works as an antenna are quite different. The main radiating antenna is a parasitic device that is excited by a separate feed antenna 9. In this first embodiment, the feed antenna 9 is also a loop, driven at one end and grounded at the other. In the embodiment shown in FIG. 1, the conductive tracks 2, 3 are each connected, at their non-grounded ends, to metallized surfaces 8 of the dielectric chip 7, which is made of a ceramic material. The metallization 8 at either end of the chip 7 contacts the opposing end surfaces and also the top surface of the chip 7. In this arrangement, the chip 7 acts in as a dielectric capacitor.

Figure 2:
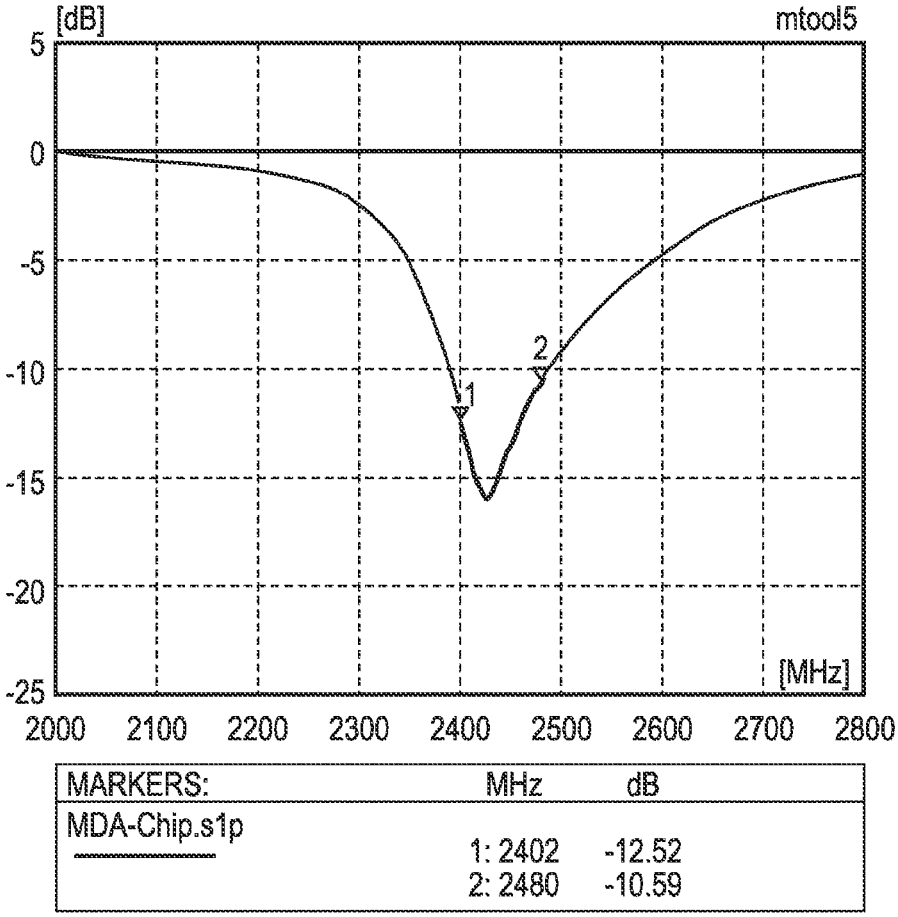
FIG. 2 is a plot showing the frequency response of the antenna arrangement of FIG. 1.
Figure 3:
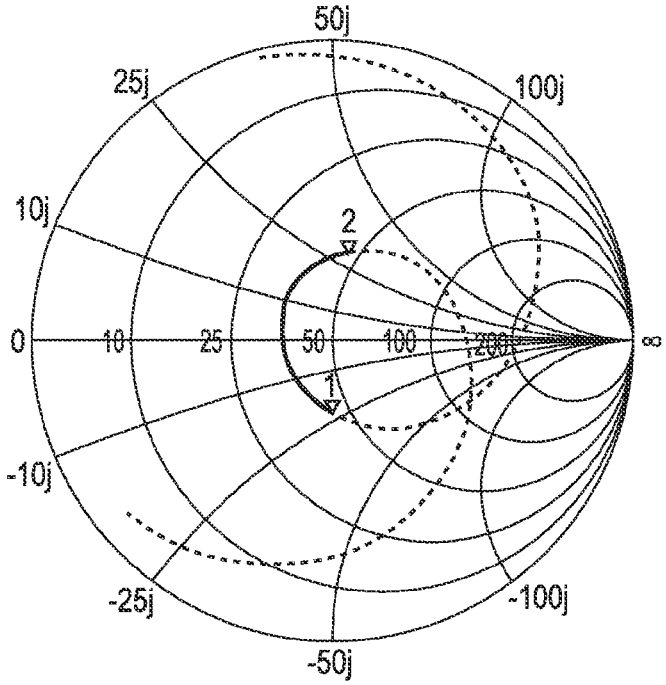
FIG. 3 is a Smith Chart plot for the antenna arrangement of FIG. 1.

The antenna arrangement shown in FIG. 1 has been built and tested using a ceramic material for the dielectric block. The relative permittivity of the ceramic was 20, but the use other permittivities is possible. A good match to 50 ohms was obtained at 2.45 GHz, see FIG. 2. The Smith Chart plot corresponding to this match is shown in FIG. 3. A two or three element matching circuit is normally used to optimize the match and was used to make these measurements.

Figure 4:
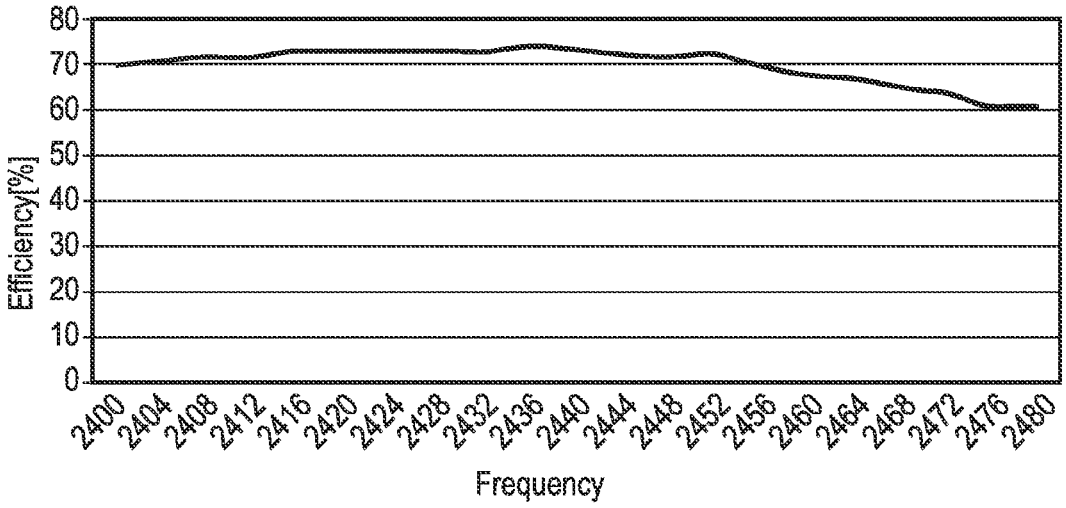
FIG. 4 is a plot showing the efficiency of the antenna arrangement of FIG. 1.

The measured efficiency of this antenna structure is good, see FIG. 4. The antenna 1 has been tested near the centre of one edge on both a long mounting board 4 (80×40 mm) and a shorter one (45×40 mm) and the performance is 60% or better in both cases. When the antenna 1 is moved towards the corner of the mounting board 4, the efficiency falls slightly, but is still 50% or better across the band. The resistance to hand detuning was excellent.

Figure 7:
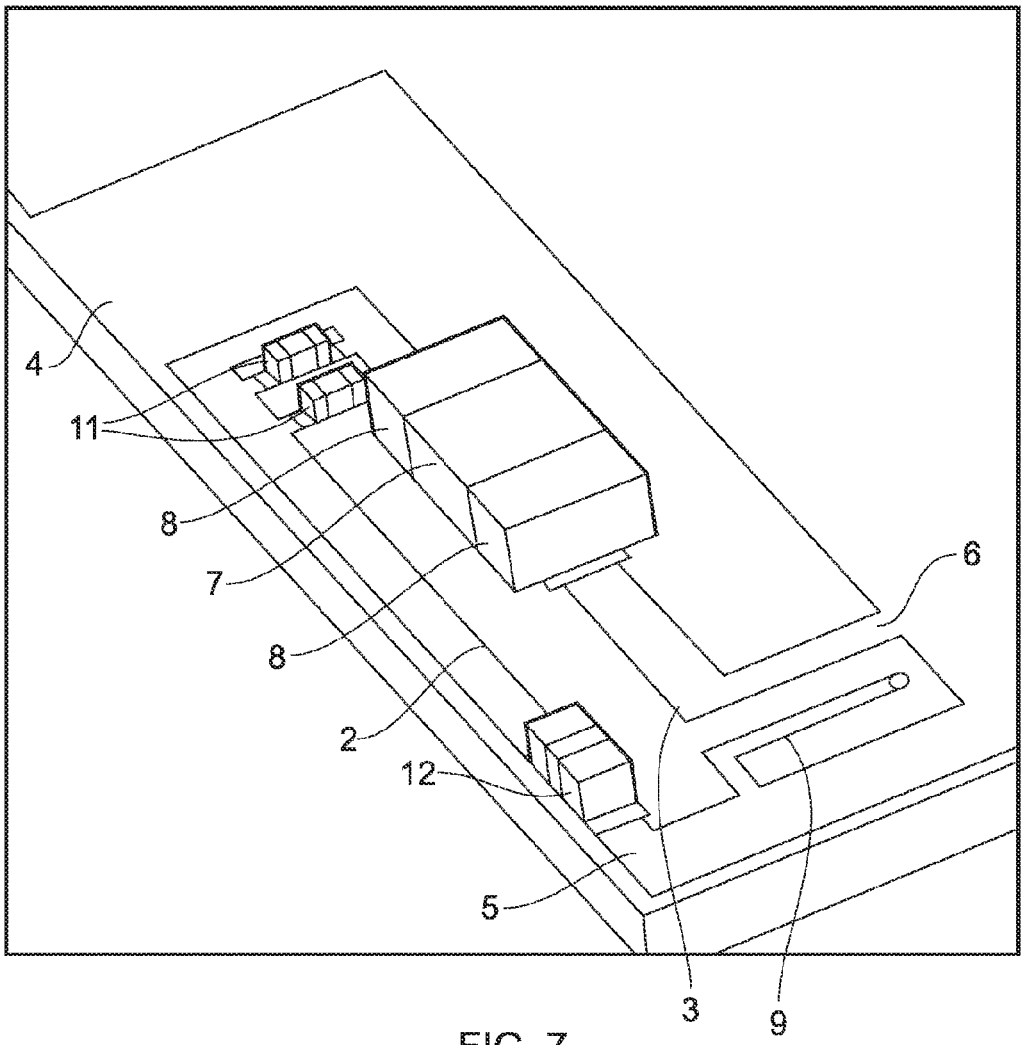
FIG. 7 illustrates further alternative embodiments of the present invention.

In a second embodiment, shown in FIG. 7, the main radiating antenna loop has pads close to the first ends of the passive radiating elements 2, 3 such that shunt zero ohm components 11 can be added. These short circuits 11 have the effect of shortening the loop and raising the resonant frequency. By this means, the antenna arrangement may be made to operate in other frequency bands without changing the structure of the dielectric block 7.

In a third embodiment, also shown in FIG. 7, the main radiating antenna loop has pads close to either the first or the second end of one or other or both of the passive radiating elements 2, 3 such that series inductive components 12 can be added. These inductors 12 have the effect of increasing the inductance of the loop and lowering the resonant frequency. By this means, the antenna arrangement may be made to operate in other frequency bands without changing the structure of the dielectric block 7.

Embodiments of the present invention take the form of a parasitic loop antenna, grounded at both ends, and with a capacitive dielectric block structure near the centre of the loop.

In a fourth embodiment the inductive feed loop 9 is replaced by a capacitive feed antenna. This has the advantage of reducing the non-ground area required and so making the whole antenna arrangement smaller. The performance of this arrangement is good, but it does not exhibit the robust resistance to detuning shown by the inductive feed arrangement 9.

Figure 5A:
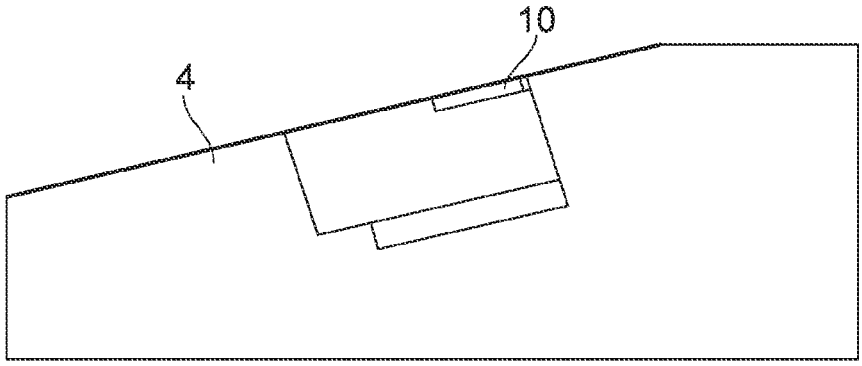
FIGS. 5*a* and 5*b* illustrate an alternative embodiment of the present invention.
Figure 5B:
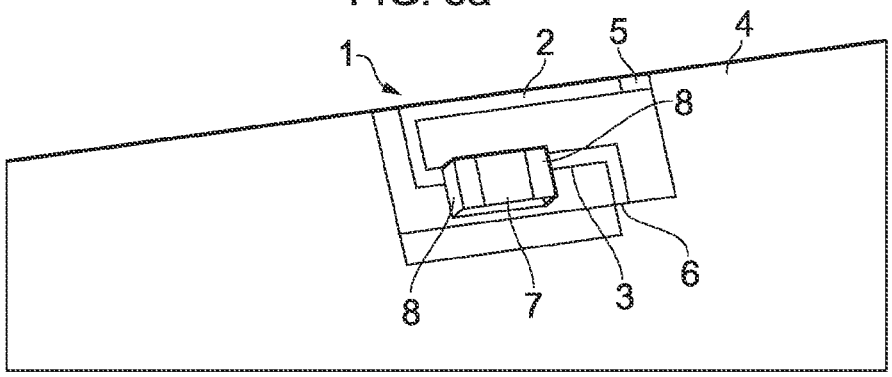

In a fifth embodiment, shown in FIGS. 5*a* and 5*b*, the feed loop 9 is replaced by a monopole antenna 10 on the underside of the mounting board substrate 4. This has the advantage of capacitive feeding of the main radiating loop, as in the fourth embodiment, but with the addition of a second radiation frequency band caused by radiation from the monopole 10 itself. In this way, dual band operation may be made possible without changing the structure of the dielectric block 7.

Figure 6:
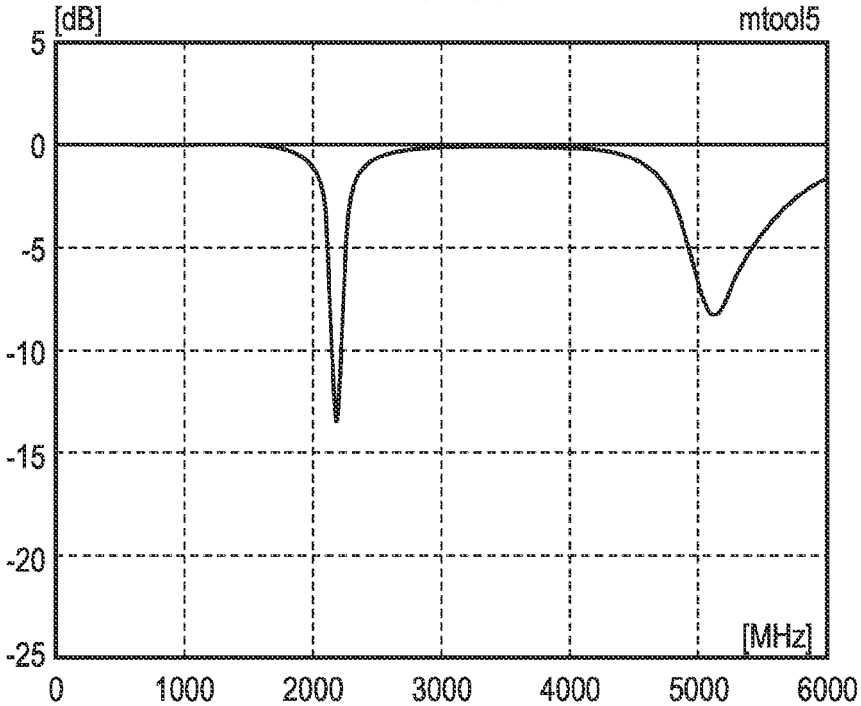
FIG. 6 is a plot showing the frequency response of the antenna arrangement of FIGS. 5*a* and 5*b*.

An example is shown in FIG. 6 where the main radiating loop resonates near 2.4 GHz and the monopole 10 radiates near 5 GHz. Operation at other frequencies is possible with this method such as 1.575 GHz GPS for one band and 2.4 GHz for the other.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The readers attention is directed to all papers and documents which are filed concurrently with or previous to this specification in connection with this application and which are open to public inspection with this specification, and the contents of all such papers and documents are incorporated herein by reference.

The invention claimed is:

1. An antenna arrangement comprising a substrate and first and second electrically conductive passive radiating elements, each passive radiating element including a conductive track routed across a surface of the substrate, each having first and second ends, the first ends of the passive radiating elements each being connected to ground, and the second ends of the radiating elements being connected respectively to mutually discrete metallized surface regions of a dielectric block positioned on the substrate, and at least one active radiating element that is not conductively connected to the passive radiating elements, wherein the passive radiating elements are configured to be fed parasitically by the at least one active radiating element.

2. An antenna arrangement as claimed in claim 1, wherein the substrate includes a dielectric substrate.

3. An antenna arrangement as claimed in claim 2, wherein the passive radiating elements comprise conductive tracks on the dielectric substrate.

4. An antenna arrangement as claimed in claim 2, wherein the active radiating element comprises a conductive track on the substrate.

5. An antenna arrangement as claimed in claim 2, wherein the active radiating element and the passive radiating elements are formed on the same surface of the substrate.

6. An antenna arrangement as claimed in claim 5, wherein the active radiating element is a magnetic loop antenna configured to couple inductively with at least one of the passive radiating elements.

7. An antenna arrangement as claimed in claim 5, wherein the active radiating element is located between the first ends of the respective passive radiating elements.

8. An antenna arrangement as claimed in claim 2, wherein the active radiating element and the passive radiating elements are formed on opposing surfaces of the substrate.

9. An antenna arrangement as claimed in claim 8, wherein the active radiating element is a monopole antenna configured to couple capacitively across the substrate with at least one of the passive radiating elements.

10. An antenna arrangement as claimed in claim 2, wherein the dielectric block is surface-mounted on the substrate.

11. An antenna arrangement as claimed in claim 2, wherein the passive radiating elements with the intervening dielectric block are arranged in a loop or hairpin configuration on the substrate so as to be configured as a magnetic loop antenna.

12. An antenna arrangement as claimed in claim 1, wherein the active radiating element is configured to radiate at substantially the same frequency or in the same frequency band as the passive radiating elements.

13. An antenna arrangement as claimed in claim 1, wherein the active radiating element is configured to radiate at a different frequency or in a different frequency band to the passive radiating elements, thereby to provide an additional frequency of operation for the antenna arrangement as a whole.

14. An antenna arrangement as claimed in claim 1, wherein the active radiating element is configured to radiate both at the same and also at a different frequency or frequency band to the passive radiating elements, thereby to provide an additional frequency of operation for the antenna arrangement as a whole.

15. An antenna arrangement as claimed in claim 1, comprising at least two active radiating elements.

16. An antenna arrangement as claimed in claim 1, wherein the dielectric block is be made of a dielectric ceramics material.

17. An antenna arrangement as claimed in claim 1, wherein the second ends of the passive radiating elements are connected to metallized pads formed on the dielectric block.

18. An antenna arrangement as claimed in claim 17, wherein the metallized pads are formed on opposing surfaces of the dielectric block.

19. An antenna arrangement as claimed in claim 17, wherein the metallized pads are formed on adjacent surfaces of the dielectric block.

20. An antenna arrangement as claimed in claim 17, wherein the metallized pads are formed on the same surface of the dielectric block.

21. An antenna arrangement as claimed in claim 17, wherein each metallized pad extends over a respective edge of the dielectric block so as to contact two adjacent surfaces simultaneously.

22. An antenna arrangement as claimed in claim 1, comprising three or more electrically conductive passive radiating elements.

23. An antenna arrangement as claimed in claim 1, additionally comprising third and fourth electrically conductive passive radiating elements, arranged in similar manner to the first and second electrically conductive passive radiating elements.

24. An antenna arrangement as claimed in claim 1, further comprising at least one inductive component connected in series on one or other or both of the first and second electrically conductive passive radiating elements.

25. An antenna arrangement as claimed in claim 1, further comprising at least one shunt component connecting first and second parts of at least one of the first and second electrically conductive passive radiating elements so as to provide a short circuit connection.

26. An antenna arrangement as claimed in claim 25, wherein the shunt component is a substantially zero ohm shunt component.

27. An antenna arrangement as claimed in claim 1 wherein at least one of the passive radiating elements is routed across the surface of the substrate between the dielectric block and the at least one active radiating element.

* * * * *